United States Patent [19]

Farrar

[11] Patent Number: 4,999,941

[45] Date of Patent: Mar. 19, 1991

[54] SELF-SEALING GRIP FOR HAND GUN

[76] Inventor: Frank W. Farrar, 12150 Bloomfield Ave., Ste. 3, Santa Fe Springs, Calif. 90670

[21] Appl. No.: 559,136

[22] Filed: Jul. 30, 1990

[51] Int. Cl.[5] ..... F41C 23/10

[52] U.S. Cl. ..... 42/71.02

[58] Field of Search ..... 42/71.02, 74

[56] References Cited

U.S. PATENT DOCUMENTS

| | | | |
|---|---|---|---|
| 3,672,084 | 6/1972 | Pachmayr | 42/71.02 |
| 3,815,270 | 6/1974 | Pachmayr | 42/71.02 |
| 4,043,066 | 8/1977 | Pachmayr et al. | 42/71.02 |
| 4,286,401 | 9/1981 | Pachmayr et al. | 42/71.02 |
| 4,359,833 | 11/1982 | Pachmayr et al. | 42/71.02 |
| 4,378,651 | 4/1983 | Pachmayr et al. | 42/71.02 |
| 4,586,282 | 5/1986 | Sniezak | 42/71.02 |
| 4,833,812 | 5/1989 | Farrar | 42/71.02 |
| 4,936,036 | 6/1990 | Sniezak et al. | 42/71.02 |

*Primary Examiner*—Charles T. Jordan
*Assistant Examiner*—Richard W. Wendtland
*Attorney, Agent, or Firm*—Beehler & Pavitt

[57] ABSTRACT

A pair of sheet metal reinforced elastomeric handgun grips has a geometry directed at preventing contaminants from entering an interior space between the handgun grips. The handgun grips have a convex exterior and a concave interior such that as a threaded fastener is tightened, a perimeter of a grip sealingly engages an exterior surface of a handgun.

16 Claims, 2 Drawing Sheets

SELF-SEALING GRIP FOR HAND GUN

BACKGROUND OF THE INVENTION

1. Field of the Invention

The present invention pertains generally to the field of firearms and in particular relates to an improved resilient grip pad for attachment to the handle of a firearm, particularly a hand gun.

2. State of the Prior Art

Most hand guns have a metallic handle with two nonmetallic grips attached to opposite sides of the handle. The grips can be made from a variety of materials, most often of a hard rubber, but also plastic, bone, ivory, etc. The nonmetallic grips give the user's hand a more secure and comfortable grip on the weapon. They do not become slippery with perspiration as easily as a metallic surface and are more comfortable to hold in hot or cold climates.

In the case of automatic pistols, the pistol handle typically also holds a clip, the ammunition magazine which is inserted into the bottom of the handle and feeds ammunition rounds to a receiver chamber situated above the handle.

In an effort to conserve weight, always an important consideration in the design of hand guns, particularly for larger caliber weapons, the handle is constructed as an open frame, where the grips also serve to cover and close the openings in the handle. These openings provide access to the magazine and generally to the interior mechanism of the hand gun.

While normally the openings in the handle frame are covered by the grips, it is still possible for foreign matter, including moisture, dust, and other contaminants, to find passage underneath the edges of the grips into the handle and then into other parts of the gun. Such contamination of the gun mechanism is undesirable and detrimental to the long-term reliability and functioning of the weapon. Since hand guns used in the field are given rugged handling, sometimes under extremes of heat and cold, the joint between the hand grips and the frame may become less than secure. It is therefore desirable to improve upon existing hand grips and to provide hand grips adapted to make a more positive and more secure seal with the handle frame to better protect the interior mechanism of the weapon under adverse environmental circumstances.

SUMMARY OF THE INVENTION

The aforementioned need is addressed by the present invention which provides grips for mounting to each side of the handle of a hand gun and which are particularly designed and adapted to make a positive elastomeric seal along the perimeter edge of the grip when it is fastened to the handle of the hand gun in the conventional fashion. The grips of this invention can be readily substituted for the original manufacturers' grips if desired.

The grip is mounted to each side of a hand gun handle having two opposite handle sides and raised bosses threaded for receiving grip fasteners. The grip has a generally planar grip body of elastomeric material having an inner face and an outer face bounded by a common perimeter of elastomeric edges lying in a common plane. The inner face is generally concave between the edges such that the edges are raised and lead the inner face in making contact against the handle side.

A stiffening sheet is embedded generally parallel to and intermediate the inner and outer faces. The sheet defines margins of unreinforced elastomeric material along the grip perimeter. The sheet and the grip body having aligned holes for passing fastener screws which thread into the handle bosses for attaching the grip to the hand gun handle. The holes in the elastomer body are larger than the holes in the stiffening sheet to define stiff rims in the hole bore between the inner and outer faces.

The hole bore between the rim and the outer face is sized for admitting the enlarged head of the screw fasteners. The screw head engages and makes an inteference fit with the rim urging the stiffening plate towards the handle frame until the grip edges are pressed into elastomeric sealing engagement along the grip perimeter with the handle side, excluding foreign matter from entry through openings in the handle and into the magazine compartment of the hand gun. The hole bore in the grip body between the rims and the inner face admit the raised bosses against the rim to limit movement of the stiffening sheet towards the handle under urging of the fastener screws.

The grip outer face is preferably convex at least in the vicinity of the perimeter and the grip edges are defined at an intersection of the convex outer face and said concave inner face, such that the edges are oriented towards the handle side when the grip is fitted to the hand gun handle.

These and other advantages and improvements of the present invention will be better understood by reference to the following detailed description of the preferred embodiments and attached drawings.

DETAILED DESCRIPTION OF THE PREFERRED EMBODIMENT

Figure 1:
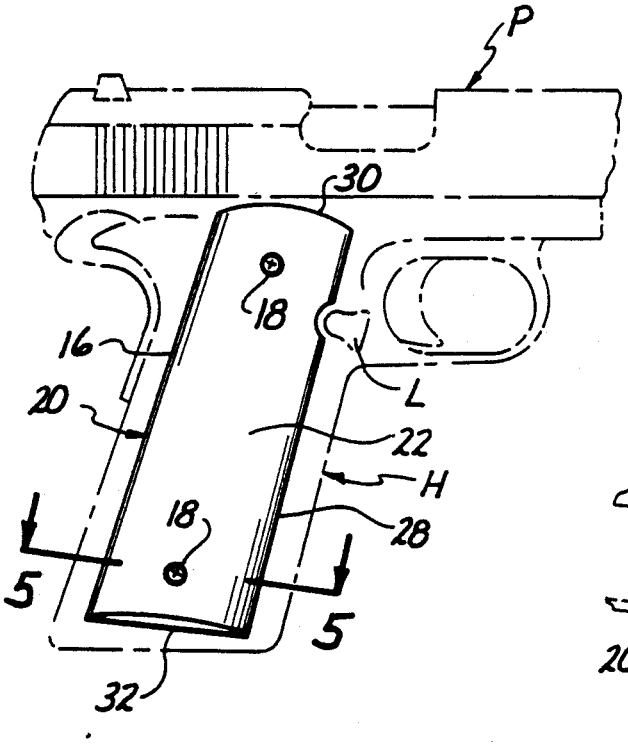
FIG. 1 is a right-hand side view of a typical automatic pistol shown in dotted lining, fitted with a grip in solid lining according to this invention.
Figure 5:
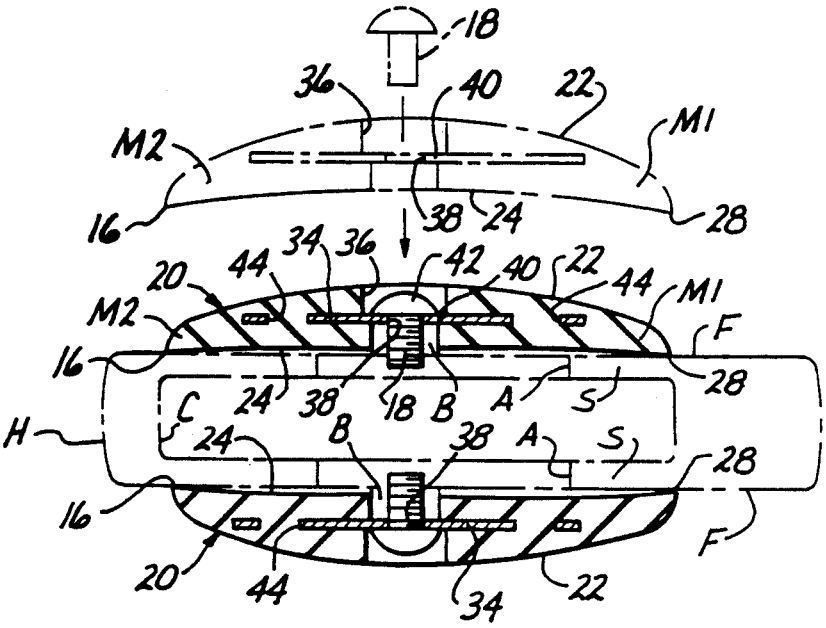
FIG. 5 is a cross-section of the gun handle in FIG. 1 taken along line 5—5 to show the fastening of the hand grips to the handle frame and the elastomeric seal at the grip side edges.
Figure 6:
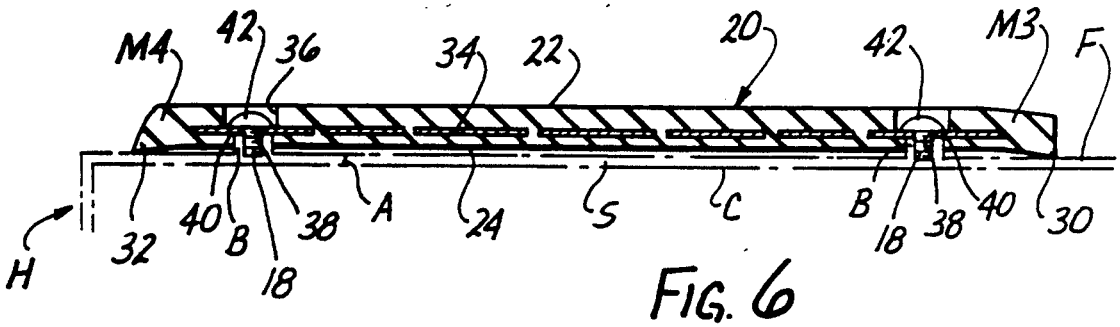
FIG. 6 is a cross section of the gun handle in FIG. 1 taken along line 6—6 to show the elastomeric seal at the grip end edges.
Figure 7:
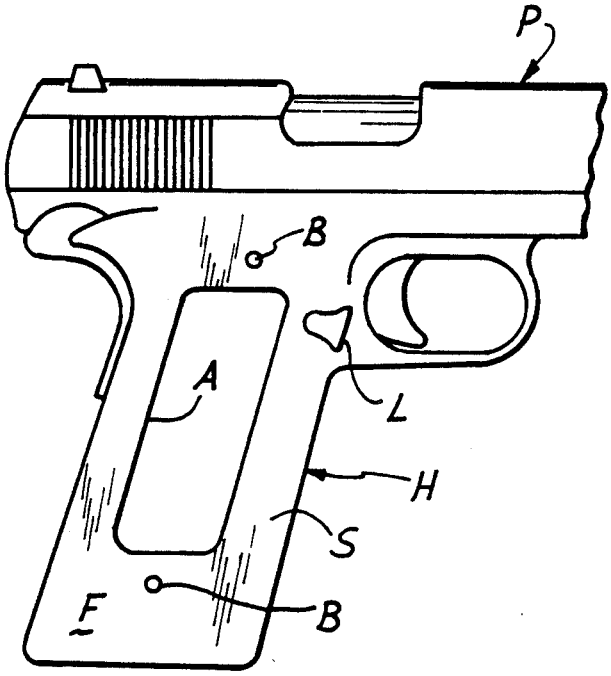
FIG. 7 shows the pistol of FIG. 1 with the grips removed to expose the handle frame openings.

With reference to the drawings, FIG. 1 shows a typical automatic pistol P with a metallic frame H integral with the trigger guard and receiver frame of the pistol. The interior of the handle H is hollow, and as seen in FIG. 5, defines a rectangular cavity C which receives an ammunition magazine or clip inserted into the open bottom of the handle H. The top of the clip feeds ammunition to the receiving chamber (not shown) situated above the handle H where rounds are fired. In FIG. 6 the handle grips have been removed to expose an aperture A which opens into the handle cavity C. A similar aperture A is on the opposite side of the handle.

As seen in FIG. 5, the handle H has a rectangular cross-section, with two opposite sides S each of which presents a flat, planar outer surface F. Two raised cylindrical bosses B are integral with each side S of the handle. Each boss B is internally threaded to receive a machine screw 18 seen in FIGS. 1, 2 and 5, for fastening a grip piece 20 to each side S of the pistol handle H. The two bosses B are located as indicated in FIG. 6 and by the positions of the two screws 18 in FIGS. 1 and 2, along a line approximately longitudinally bisecting each side of the handle: one above and one below the aperture A. This aperture, which eliminates unnecessary metal from the pistol frame as a weight-saving measure, opens into the magazine cavity C and hence into the receiver chamber and firing mechanism at the upper end of the magazine cavity. It is consequently of great importance to close the openings A securely to prevent entry of moisture or foreign matter. The grips 20 of this invention have been improved with this objective in mind.

Each grip 20 is a flat elongated body of elastomeric material having an outer face 22 and an inner face 24, both faces being bounded at a common perimeter defined by two side edges 26, 28 and upper and lower end edges 30, 32, respectively.

As best seen in FIG. 5, the inner side of the grip 20 is concave between the side edges 26, 28 as well as between the end edges 30 and 32. The edges consequently are raised relative to the central area of the inner face 24. Both the side and end edges of the grip 20 lead the remainder of the inner side 24 and the grip body in making contact with the handle side S when the grip 20 is assembled to the pistol handle, as shown in FIG. 5. The outer face 22 of the grip is generally convex, particularly in the vicinity of the side edges 26, 28 and end edges 30, 32 which preferably taper to relatively narrow edges facing the pistol handle and lying in a common plane.

Figure 3:
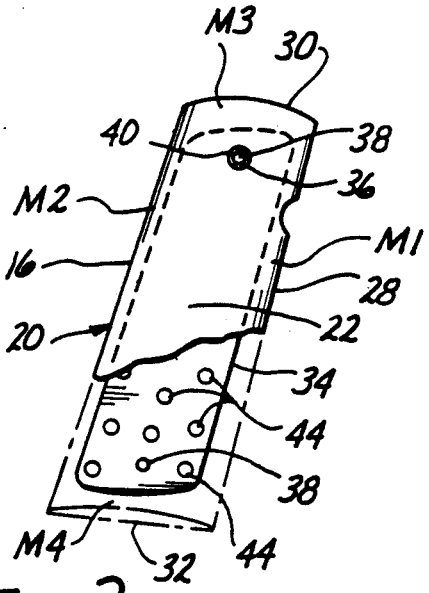
FIG. 3 is a plan view of the exterior side of a right-hand grip partly broken away to show the embedded stiffening plate.
Figure 4:
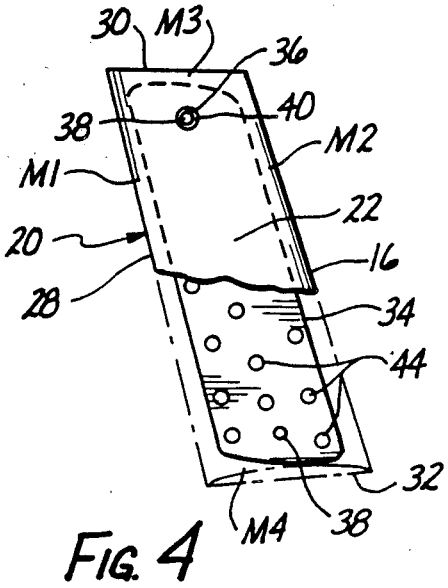
FIG. 4 is a view as in FIG. 3 of the matching left-hand grip.

A stiffening plate 34 is embedded in the elastomeric body of the grip 20, generally parallel to and intermediate the inner and outer faces 22, 24, as shown in FIGS. 3, 4, and 5. The plate 34 is a relatively stiff but nontheless somewhat yielding sheet of metal, such as stainless steel, shaped to generally follow the perimeter shape of the grip 20 but is smaller in its side dimensions, so as to leave unreinforced margins M1, M2, M3 and M4, extending along each edge of the grip 20, between each edge of plate 34 and the corresponding edge of the grip. The stiffening plate 34 has multiple other perforations 44 for the purpose of removing unnecessary plate material in the interest of minimizing the weight of the grip 20 without sacrificing strength of the plate 34.

Turning to FIGS. 5 and 6, the grip 20 has two holes 36, each aligned with a hole 38 in the stiffening plate 34. The hole 38 is of smaller diameter than the hole 36 so that the plate defines an annular rim 40 which extends into the grip hole 36 at a level intermediate the inner and outer faces of the grip. Each grip hole 36 between the rim 40 and inner face 24 is sized to admit one of the two bosses 24 of the hand grip, as shown in FIG. 5, when the grip 20 is assembled to one side S of the pistol handle H. The fastener screw 18 has an enlarged screw head 42 which fits into the grip hole 36 between the rim 40 and the outer face 22 and makes an interference fit with the rim 40 when the screw 18 is threaded into a boss B and draws the stiffening plate 34 towards the handle side S.

In FIG. 5 the grip cross section in dotted lining shows the curvature of the inner face before attachment of the grip to the pistol handle. Because of the concave nature of the inner side 24 of the grip, the four edges defining the perimeter of the grip make the initial contact with the surface F of the handle. As the stiffening plate 34 is urged towards the handle side S by the fastening screws 18, the leading edges of the grip are pressed against the handle side surface F and the unreinforced margins M1–M4, which retain significant resiliency for lack of internal stiffening, conform as necessary to make an elastomeric seal with the handle surface F extending along the four edges 26–32 of the grip 20. This elastomeric seal is sustained by virtue of the inherent resiliency of the elastomeric material constituting the grip body 20 so long as the stiffening plate 34 is secured to the bosses B by the fasteners 18. The integrity of the elastomeric seal is assured in part by the spacing between the stiffening plates 34 and the inner grip surface 24. The depth between the plate and the leading seal edges of the grip is such that the seal edges are pressed firmly against the handle surface F when the plate is drawn up against the top of the bosses B by the screw 18. The fastener screw 18 is threaded into the boss B until the stiffening plate 34 is stopped against further advance towards the handle surface F by contact with the end face of the boss B. At this point the leading edges 26–32 will have made positive contact with the handle surface F and the margins M1–M4 already pressed against the handle surface F and flattened slightly from their normal convex curvature prior to mounting of the grip, so as to maintain the edges 26–32 under elastomeric bias into sealing engagement with the handle surface F along the grip perimeter, a condition illustrated in solid lining in FIGS. 5 and 6. In FIG. 5 the pistol handle H is fitted with two grips 20, one on each side of the handle H, as is customary.

Figure 2:
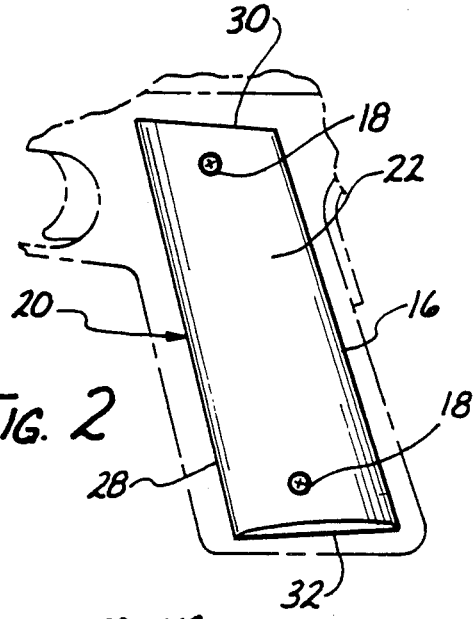
FIG. 2 is a fragmentary left-hand side view of the automatic pistol of FIG. 1 showing the opposite side of the handle fitted with a matching grip according to this invention.

There are slight differences in the geometry of the left-hand and right side grips as will be evident from comparison of FIGS. 1 and 3 with FIGS. 2 and 4. These differences allow for certain asymmetries in the pistol P, such as the provision of a safety latch L on the right-hand side of the pistol which is accommodated by a notch 46 in the right-hand grip piece 20, while no such notch is needed on the left-hand grip for this particular pistol. Also, the top edge 30 is convexly curved on the right-hand grip, while it is substantially straight on the opposite grip piece. These minor geometrical asymmetries between the two have no significant effect on the self-sealing qualities of the grip pieces described above, and various such adaptations can be made as may be necessary for fitting similar grip pieces to other hand gun designs.

From the foregoing it will be appreciated that the novel grips of this invention provide improved protection to the mechanism of the firearm against contamination and interference by foreign material, and can be easily fitted without modifying the hand gun.

While a particular, presently preferred embodiment of the invention has been shown and described for purposes of clarity and example, it must be understood that various changes, modifications and substitutions can be made to the described embodiment by those possessed of ordinary skill in the art without thereby departing from the scope and spirit of the present invention which is defined by the following claims.

What is claimed is:

1. A grip for mounting to each side of a hand gun handle frame having a magazine compartment between two opposite handle sides, said grip comprising:

a generally planar grip body of elastomeric material having an inner face and an outer face bounded by a common perimeter including side edges and end edges, said inner face being generally concave between said edges;

stiffening means embedded in said planar body;

fastener means for securing said grip body with said inner face against said handle side;

said fastener means engaging and urging said stiffening means at points spaced from said edges towards said handle frame such that said edges are pressed into elastomeric sealing engagement along said perimeter with said handle side, whereby foreign matter is excluded from entry into said magazine compartment.

2. The grip of claim 1 wherein said stiffening means comprise sheet means extending generally parallel to and intermediate said inner and outer faces.

3. The grip of claim 2 wherein said sheet means is made of sheet metal.

4. The grip of claim 1 wherein said stiffening means is a metallic sheet perforated for passing said fastener means and extending generally parallel to and intermediate said inner and outer faces.

5. The grip of claim 4 wherein said metallic sheet has edges spaced from said side edges and end edges of the grip body.

6. The grip of claim 5 wherein said grip body has holes aligned with said perforations in said metallic sheet for passing said fastener means through said grip body.

7. A grip for mounting to each side of a hand gun handle frame having a magazine compartment between two opposite handle sides, said grip comprising:

a generally planar grip body of elastomeric material having an inner face and an outer face bounded by a common perimeter of elastomeric edges, said inner face being generally concave between said edges such that said edges are raised and lead said inner face in making contact against said handle side;

fastener means for securing said grip body with said inner face against said handle side;

a stiffening sheet embedded generally parallel to and intermediate said inner and outer faces, said sheet and said grip body having aligned holes for passing said fastener means;

said fastener means engaging and urging said stiffening means at points spaced from said elastomeric edges towards said handle frame such that said edges are pressed into elastomeric sealing engagement along said perimeter with said handle side, whereby foreign matter is excluded from entry into said magazine compartment.

8. The grip of claim 7 wherein said stiffening sheet has sheet edges spaced from said perimeter to define unreinforced margins of elastomeric material along said perimeter.

9. The grip of claim 7 wherein said holes in said sheet are smaller than said holes in said grip to provide a rim in each hole engageable by said fasteners thereby to positively urge said stiffening sheet towards said handle side and thus urge said elastomeric edges into said sealing engagement.

10. The grip of claim 9 wherein said fasteners are machine screws with enlarged screw heads for engaging said rim.

11. The grip of claim 9 wherein each handle side of the hand gun has raised bosses threaded for receiving grip fasteners, said grip further characterized in that said bosses are received in said holes in the grip body are sized for making an interference fit with said rims and thereby limiting movement of said stiffening means towards said handle face under the urging of said fasteners.

12. A grip for mounting to each side of a hand gun handle having a magazine compartment between two opposite handle sides and raised bosses on each side threaded for receiving grip fasteners, said grip comprising:

a generally planar grip body of elastomeric material having an inner face and an outer face bounded by a common perimeter of elastomeric edges, said inner face being generally concave between said edges such that said edges are raised and lead said inner face in making contact against said handle side;

screw fasteners threadable into said boss means for securing said grip body with said inner face against said handle side;

a stiffening sheet embedded generally parallel to and intermediate said inner and outer faces, said sheet defining margins of unreinforced elastomeric material along said perimeter, said sheet and said grip body having aligned holes for passing said fastener means, the holes in said sheet being smaller to define rims intermediate said inner and outer faces extending into the holes in the grip body;

the holes in said grip body between said rims and said outer face being sized for admitting screw heads on said screw fasteners into engagement with said rims and urging said stiffening means towards said handle frame such that said edges are pressed into elastomeric sealing engagement along said perimeter with said handle side, whereby foreign matter is excluded from entry into said magazine compartment, the holes in said grip body between said rims and said inner face being sized for admitting said raised bosses against said rims to limit movement of said stiffening sheet towards said inner face under urging of said fastener means.

13. The grip of claim 12 wherein said stiffening sheet is a metallic sheet.

14. The grip of claim 12 wherein said stiffening sheet is further multiply perforated to reduce the weight thereof.

15. The grip of claim 12 wherein said outer face is generally convex at least in the vicinity of said perimeter and said grip edges are defined at an intersection of the convex outer face and said concave inner face, such that said edges are oriented towards the handle side when the grip is fitted to the hand gun handle.

16. The grip of claim 12 wherein said unreinforced margins are approximately one-quarter inch between the edges of said stiffening sheet and the perimeter of the grip.

* * * * *